US005996988A

United States Patent [19]

Helmstädter et al.

[11] Patent Number: 5,996,988

[45] Date of Patent: Dec. 7, 1999

[54] DEVICE FOR PRODUCING A SCALED STREAM WITH A CONTROLLABLE SCALED-STREAM THICKNESS

[75] Inventors: Maximilian Helmstädter, Villingen-Schwenningen; Josef Batzer, Stadtbergen; Karl Zimmermann, Augsburg, all of Germany

[73] Assignee: Bowe Systec AG, Augsburg, Germany

[21] Appl. No.: 09/029,409

[22] PCT Filed: Feb. 13, 1997

[86] PCT No.: PCT/EP97/00678

§ 371 Date: Feb. 27, 1998

§ 102(e) Date: Feb. 27, 1998

[87] PCT Pub. No.: WO97/30919

PCT Pub. Date: Aug. 28, 1997

[30] Foreign Application Priority Data

Feb. 23, 1996 [DE] Germany ..... 196 06 832

[51] Int. Cl.[6] ..... B65H 7/08

[52] U.S. Cl. ..... 271/110; 271/121; 271/265.04; 271/3.02

[58] Field of Search ..... 271/3.03, 3.05, 271/3.02, 3.01, 10.03, 10.09, 10.1, 10.11, 110, 116, 121, 265.04, 263

[56] References Cited

U.S. PATENT DOCUMENTS

| | | | |
|---|---|---|---|
| 3,339,705 | 9/1967 | Burkhardt et al. | 271/3.05 |
| 3,612,511 | 10/1971 | Godlewski | 271/35 |
| 3,776,544 | 12/1973 | Watson et al. | 271/35 |
| 3,933,350 | 1/1976 | Mignano | 271/10.09 |
| 4,134,580 | 1/1979 | Duzinskas et al. . | |
| 5,098,078 | 3/1992 | Nakanishi | 271/10.11 |

FOREIGN PATENT DOCUMENTS

| | | |
|---|---|---|
| 0556486 A1 | 8/1993 | European Pat. Off. . |
| 2060989 | 6/1972 | Germany . |
| 2203626 | 8/1973 | Germany . |
| 2401530 | 7/1975 | Germany . |
| 2930270 A1 | 3/1981 | Germany . |

OTHER PUBLICATIONS

International Search Report of Jun. 20, 1997 (in German).

*Primary Examiner*—H. Grant Skaggs
*Attorney, Agent, or Firm*—Wolf, Greenfield & Sacks, P.C.

[57] ABSTRACT

A device for producing a scaled stream with a controllable scaled-stream thickness has a sheet guiding device for receiving therein a stack of sheets, a first transport means, which has a selectively operable or controllable drive, which engages only the lower surface of the stack of sheets and which is arranged relative to the stack of sheets in such a way that the stack of sheets rests thereon with at least a first part of its weight, a second transport means, which is arranged behind the first transport means when seen in the direction of the stream of sheets, which is arranged relative to the stack of sheets in such a way that, when the second transport means is operated without operating the first transport means, it will transport only sheets which have already been drawn out of the stack of sheets by the first transport means, and which is also arranged relative to the stack of sheets in such a way that the stack of sheets rests thereon only with a second part of its weight, the second part of its weight being small in comparison with the first part; a scaled-stream thickness detection device for detecting the scaled-stream thickness, which operates or controls the drive of the first transport means in response to the detected scaled-stream thickness.

10 Claims, 1 Drawing Sheet

DEVICE FOR PRODUCING A SCALED STREAM WITH A CONTROLLABLE SCALED-STREAM THICKNESS

FIELD OF THE INVENTION

The present invention deals with a device for producing a fish-scale-like stream with a controllable stream thickness. In particular, the present invention deals with a stacked-sheet feeder comprising a sheet guiding device from which sheets can be removed in the form of a scaled stream having a controllable scaled-stream thickness.

BACKGROUND OF THE INVENTION

A stacked-sheet prefeeder normally comprises a sheet guiding device for receiving therein a comparatively large stack of sheets, and a device for producing a scaled stream, which removes from the lower surface of the stack of sheets held in the sheet guiding device sheets in the form of a stack or in a scalelike mode of arrangement and which supplies the resultant scaled stream to an intermediate tray from which individual sheets are removed by a separation device so that they can be processed subsequently. It follows that such a scaled-stream production device is normally a component of a two-step separation principle in the case of which a scaled stream is first formed from a large stack of sheets, the scaled stream being then, finally, converted into a stream of paper consisting of separate sheets. Such a scaled-stream production device comprises, typically, a feed roll engaging a stack of sheets on the lower surface of the entire stack, which is held by the sheet guiding device, and transporting the stack of sheets in the direction of the intermediate tray. For limiting the height of the stack, a stack height limitation device is typically arranged in the area of the lower edge of the entire stack; the typical components of the stack height limitation device are a rotating roll and a stationary roll, which is arranged at a fixed distance from the rotating roll and the free distance of which delimits the height of the substacks removed from the lower surface of the entire stack. The scaled stream produced by this type of device is often irregular with regard to the scale distances and the scaled-stream thickness.

DE-A 29 30 270 discloses a means for detecting irregularities in the sheet supply to a sheet-processing machine, which is provided with a measuring device for detecting a size that increases as the number of superimposed sheets increases and an evaluation means with the aid of which an electric signal can be supplied if irregularities should occur. FIG. 1 shows a feeder with a stack to be fed from which the sheets are removed by means of a suction device and are fed to the printing machine via a feed table and alignment devices. Prior to the feed table, a feed roll is provided, which can be lifted by means of a suitable control so that a respective new sheet can be introduced. This feed roll is spring urged towards a lower roll. The distance between these rolls corresponds to the thickness of the sheets disposed between the rolls, the distance being measured by a distance sensor. Suitably weighted or averaged output signals of the distance sensor are compared with a stored reference value so that a double sheet or an imperfect sheet can be identified.

SUMMARY OF THE INVENTION

It is the object of the present invention to provide a device for producing a scaled stream with a controllable scaled-stream thickness.

The present invention presents a device for producing a scaled stream with a controllable scaled-stream thickness, the device having a sheet guiding device for receiving therein a stack of sheets, a first transport means, which has a selectively operable or controllable drive, which engages only the lower surface of the stack of sheets, and which is arranged relative to the stack of sheets in such a way that the stack of sheets rests thereon with at least a first part of its weight. The device further has a second transport means, which is arranged behind the first transport means when seen in the direction of the stream of sheets, which is arranged relative to the stack of sheets in such a way that, when the second transport means is operated without operating the first transport means, it will transport only sheets which have already been drawn out of the stack of sheets by the first transport means, and which is also arranged relative to the stack of sheets in such a way that the stack of sheets rests thereon only with a second part of its weight, the second part of its weight being small in comparison with the first part. The device includes a scaled-stream thickness detection device for detecting the scaled-stream thickness, which operates or controls the drive of the first transport means in response to the detected scaled-stream thickness.

The device for producing a scaled stream according to the present invention includes a sheet guiding device for receiving therein a stack of sheets, two transport means that are independent of each other and a scaled-stream thickness detection device. One of the two transport means has a selectively operable or controllable drive. This transport means engages the lower surface of the stack of sheets and is arranged relative to the stack of sheets, preferably at the centre of the lowermost sheet of a slightly inclined stack of sheets, in such a way that the stack of sheets rests thereon with at least a first part of its weight, preferably more than 30% of its weight. The second transport means is arranged behind the first transport means when seen in the direction of the stream of sheets. The point where the second transport means is arranged is preferably located at the edge of the lowermost sheet of the stack of sheets that lies in the direction of the stream of sheets when seen from the first transport means. The second transport means is preferably driven continuously, i.e. constantly when the scaled stream production device is in operation. The location of this second transport means relative to the stack of sheets is chosen such that the stack of sheets rests on the second transport means with so small a second part of its weight, or with no part thereof at all, that, when the second transport means is operated while the first transport means is at rest, only sheets will be transported which have already been removed from the stack of sheets with the aid of the first transport means. The above-mentioned scaled-stream thickness detection device is located behind the first transport means, preferably also behind the second transport means when seen in the direction of the stream of sheets; the scaled-stream thickness detection device detects the thickness of the scaled stream and switches the drive of the first transport means on and off in response to the detected scaled-stream thickness, or it controls the speed of the drive in response to the detected scaled-stream thickness.

When the scaled-stream thickness exceeds a maximum value, the scaled-stream thickness detection device responds and switches the drive of the first transport means off in accordance with a preferred embodiment of the present invention, whereupon the second transport means will only transport substacks or scales which had already been removed from the entire stack by the first transport means. This has the effect that the scaled stream will lengthen, the distances between the individual scales will enlarge and the scaled-stream thickness will, consequently, decrease until the scaled-stream thickness detection device detects that the instantaneous scaled-stream thickness falls below the above-mentioned maximum value, whereupon the first transport means is actuated again.

BRIEF DESCRIPTION OF THE DRAWING

In the following, preferred embodiments of the present invention are described in detail making reference to the drawing enclosed, in which.

DESCRIPTION OF A PREFERRED EMBODIMENT

Figure 1:
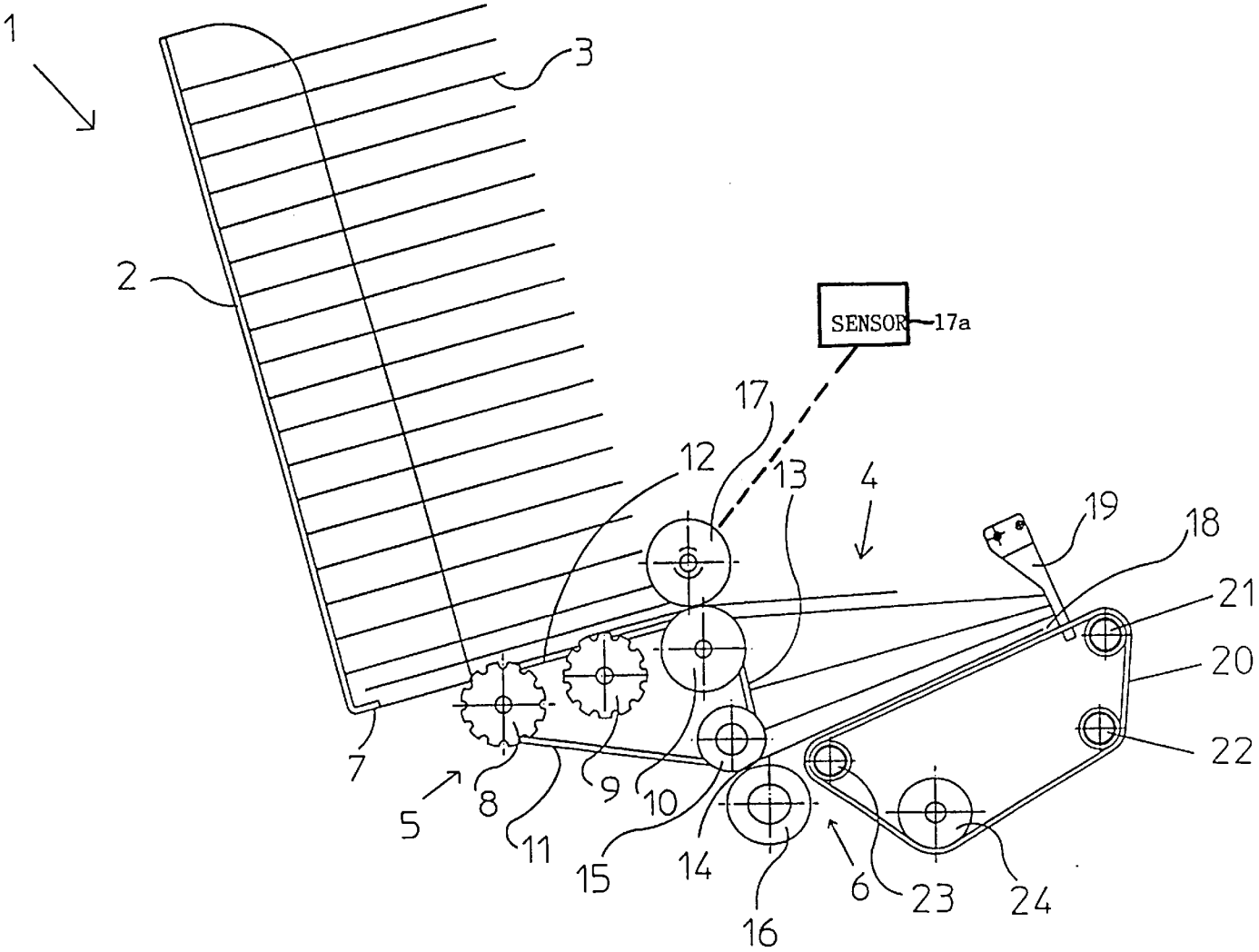
FIG. 1 shows a schematic side view of a stacked-sheet prefeeder provided with a preferred embodiment of the device for producing a scaled stream.

A stacked-sheet prefeeder, designated generally by reference numeral 1 in the only FIGURE, comprises as main components a sheet guiding device 2 used for receiving therein a stack 3 of sheets, an intermediate tray 4, a scale former 5 for removing sheets, arranged in a stack or in a scalelike mode of arrangement, jointly from the lower surface of the stack 3 received in the sheet guiding device 2 and for introducing these sheets into the intermediate tray 4 in a first direction of movement, and a sheet separator 6 for removing from the intermediate tray 4 the respective lowermost sheet as a single sheet in a second direction of movement which is substantially opposed to the first direction of movement.

The scale former 5 comprises first, second and third feed rolls in the bottom area 7 of the sheet guiding device 2. The first feed roll 8 is located essentially centrally below the stack 3 so that most of the weight of the stack 3 rests thereon. Whereas the second and third feed rolls 9, 10 are driven substantially continuously when the stacked-sheet prefeeder is in operation, the drive of the first feed roll 8 can be switched off by means of a clutch (not shown) in response to a control which will be explained hereinbelow. A round belt 11, which is also driven by the third feed roll 10, comprises a first belt section 12 extending from the first to the third feed roll 8, 10 along the bottom area 7 of the sheet guiding device 2, and a second belt section 13 extending in the interior of the intermediate tray 4 from the driven third feed roll 10 at an oblique angle downwards up to a separation point 14 of the sheet separator 6. The separation point 14 is defined by an area of approach of a stationary separation roll 15 and a discharge roll 16, the rolls 15 and 16 being arranged at the separation point 14 at a distance from one another which is so small that the discharge roll 16 can never draw more than a single sheet through the nip between the discharge roll 16 and the separation roll 15.

A non-driven roll 17 is spring suspended above the third feed roll 10 such that it is movable in the vertical direction. The vertical position of the roll 17 is detected by a sensor (not shown), which responds when a maximum value of the thickness of the scaled stream moving between the roll 17 and the third feed roll 10 is exceeded, whereupon the feed roll 8 is stopped by opening the clutch of the feed roll 8. In this condition of rest of the first feed roll 8, the second and third feed rolls 9, 10 as well as the round belt 11 continue to rotate, whereby the scale distances of the scaled stream supplied to the intermediate tray 4 are enlarged; this has the effect that the scaled stream lengthens until the thickness of the scaled stream detected by the roll 17 has been reduced to a desired target value; when the target value is detected, the sensor reengages the clutch of the first feed roll 8, whereby the feed roll 8 is caused to rotate again.

At the side of the intermediate tray 4 located opposite the second belt section 13 of the round belt 11, a stop 19 is provided whose position can be adjusted parallel to a bottom area 18 of the intermediate tray in dependence upon the size of the sheets processed by the stacked-sheet prefeeder 1.

The bottom area 18 of the intermediate tray 4 is arranged such that it slopes downwards towards the separation point 14, whereby the sheets contained in the intermediate tray 4 abut on the second belt section 13 of the round belt 11 with the sheet edge constituting the left hand-side sheet edge in the FIGURE.

In the bottom area 18 of the intermediate tray 4, a friction belt 20, which extends parallel to the bottom area, is guided over three guide pulleys 21 to 23 and a drive pulley 24, the friction belt 20 being driven such that the respective lowermost sheet resting thereon is displaced within the intermediate tray 4 towards the separation point 14.

In the embodiment shown, the first feed roll 8 constitutes the first transport means. Reference should be made to the fact that, for the purpose of the present invention, the first feed roll can also be defined by other conveying means, such as a separate belt drive.

In the present embodiment, the second transport means is defined by two continuously driven feed rolls 9, 10 and the first belt conveying section 12. Also this second transport means can consists of other, preferably continuously moving conveying means, provided that these conveying means are implemented and arranged in such a way that, when the second transport means alone is operated without operating the first transport means, the second transport means will transport only sheets which have already been drawn out of the stack of sheets by the first transport means, the stack of sheets being held by the sheet guiding device.

What is claimed is:

1. A device for producing a scaled stream with a controllable scaled-stream thickness, comprising a sheet guiding device for receiving therein a stack of sheets;

a first transport means, which has a selectively operable or controllable drive, which engages only the lower surface of the stack of sheets, and which is arranged relative to said stack of sheets in such a way that said stack of sheets rests thereon with at least a first part of its weight;

a second transport means, which is arranged behind said first transport means when seen in the direction of said stream of sheets, which is arranged relative to said stack of sheets in such a way that, when said second transport means is operated without operating the first transport means, it will transport only sheets which have already been drawn out of the stack of sheets by the first transport means, and which is also arranged relative to said stack of sheets in such a way that said stack of sheets rests thereon only with a second part of its weight, said second part of its weight being small in comparison with the first part;

a scaled-stream thickness detection device for detecting the scaled-stream thickness, which operates or controls the drive of the first transport means in response to the detected scaled-stream thickness.

2. A device according to claim 1, wherein the first transport means is defined by a first feed roll engaging the stack of sheets essentially in the middle of the lowermost sheet of said stack of sheets.

3. A device according to claim 2, wherein the second transport means comprises at least one additional feed roll and a belt conveying means including a belt section which extends along a bottom area of the sheet guiding device, said at least one additional feed roll and said belt conveying section supplying to the scaled-stream thickness detection device the sheets which have been removed in the form of a stack or in a scalelike mode of arrangement from the lower surface of the stack of sheets.

4. A device according to claim 1, wherein the second transport means is driven by a continuous drive.

5. A device according to claim 1, wherein the second transport means extends up to an area below the edge of the stack of sheets.

6. A device for producing a scaled stream with a controllable scaled-stream thickness, comprising:

a sheet guiding device for receiving therein a stack of sheets;

a first transport means, which has a selectively operable or controllable drive, which engages only the lower surface of the stack of sheets, and which is arranged relative to said stack of sheets in such a way that said stack of sheets rests thereon with at least a first part of its weight;

a second transport means, which is arranged behind said first transport means when seen in the direction of said stream of sheets, which is arranged relative to said stack of sheets in such a way that, when said second transport means is operated without operating the first transport means, it will transport only sheets which have already been drawn out of the stack of sheets by the first transport means, and which is also arranged relative to said stack of sheets in such a way that the stack of sheets does not rest thereon; and a scaled-stream thickness detection device for detecting the scaled-stream thickness, which operates or controls the drive of the first transport means in response to the detected scaled-stream thickness.

7. A device according to claim 6, wherein the first transport means is defined by a first feed roll engaging the stack of sheets essentially in the middle of the lowermost sheet of said stack of sheets.

8. A device according to claim 7, wherein the second transport means comprises at least one additional feed roll and a belt conveying means including a belt section which extends along a bottom area of the sheet guiding device, said at least one additional feed roll and said belt conveying section supplying to the scaled-stream thickness detection device the sheets which have been removed in the form of a stack or in a scale-like mode of arrangement from the lower surface of the stack of sheets.

9. A device according to claim 6, wherein the second transport means is driven by a continuous drive.

10. A device according to claim 6, wherein the second transport means extends up to an area below the edge of the stack of sheets.

* * * * *